United States Patent [19]

Lawson

[11] 3,961,502

[45] *June 8, 1976

[54] SAFETY RING

[75] Inventor: James N. Lawson, Fairmont, N.C.

[73] Assignee: Musselwhite Enterprises, Inc., Lumberton, N.C. ; a part interest

[ * ] Notice: The portion of the term of this patent subsequent to June 8, 1992, has been disclaimed.

[22] Filed: Jan. 24, 1973

[21] Appl. No.: 326,399

[52] U.S. Cl. ..... 66/163; 339/6 R

[51] Int. Cl.[2] ..... D04B 35/14; D04B 35/16

[58] Field of Search ..... 66/163, 161, 157; 339/2.6, 2 R, 2 A, 2 L, 2 RL, 6 R, 6 A; 200/61.13, 61.14; 139/353, 370; 57/81; 28/51; 242/131, 131.1

[56] References Cited

UNITED STATES PATENTS

| | | | |
|---|---|---|---|
| 803,042 | 10/1905 | Wynne et al. | 66/163 |
| 1,775,298 | 9/1930 | Wachsman | 66/163 |
| 2,168,754 | 8/1939 | Wachsman et al. | 66/163 |
| 2,309,367 | 1/1943 | Wachsman | 66/163 |
| 2,324,442 | 7/1943 | Wachsman | 339/6 |
| 2,387,100 | 10/1945 | Wachsman | 66/163 |
| 2,432,953 | 12/1947 | Vossen | 66/163 |
| 3,132,495 | 5/1964 | Antonevich | 66/163 |
| 3,530,689 | 9/1970 | Yarbrough | 66/163 X |

*Primary Examiner*—James Kee Chi

*Attorney, Agent, or Firm*—Clarence A. O'Brien; Harvey B. Jacobson

[57] ABSTRACT

A safety ring for a stop mechanism of a knitting machine has an electrically conductive bar arranged in a circle passing through several electrically insulating rings. Each insulating ring has a stiff wire connected to it and clamped to the frame of a knitting machine. The bar is grounded, and forms a portion of an electrical circuit which when closed will stop the associated knitting machine.

10 Claims, 4 Drawing Figures

SAFETY RING

BACKGROUND OF THE INVENTION

1. Field of the Invention

This invention relates generally to stop mechanisms for knitting machines, and particularly to a safety ring for protecting stop motion switches.

2. Description of the Prior Art

Knitting machines, especially circular knitting machines, are commonly provided with stop motion switches. These switches, examples of which may be found in U.S. Pat. No. 2,329,427, are each associated with a thread of yarn, and act to stop the machine whenever a thread breaks or the yarn supply on a cone associated with the switch becomes exhausted. If the stop motion switch is defective and the machine is not stopped in the presence of these conditions, needles, of which there may be approximately four hundred, will be broken by thread build-up at their tips. The breaking of the needles will also ruin the material being knitted by the machine. Further, a mechanic may spend an entire work day restoring the machine to working order. It is virtually impossible to determine if a stop motion switch is defective before it fails to function during operation of the knitting machine.

SUMMARY OF THE INVENTION

It is an object of the present invention to provide an apparatus which will ensure that a stop motion switch will close a circuit to stop the associated knitting machine when a thread associated with the switch breaks or terminates.

It is another object of the present invention to provide a stop motion switch protecting apparatus which may be installed on existing knitting machines.

These and other objects are achieved according to the present invention by providing a grounded safety ring arranged in the path of electrically conductive wires associated with stop motion switches.

Preferably, the safety ring has: an electrically conductive, slender bar arranged in a circle; at least one insulating ring, the wire arranged passing through this insulating ring; and an electrically conductive wire grounding the slender bar to the machine frame.

The circle-forming slender bar, which may also be referred to as a ring, may be mounted on a knitting machine as by stiff wire attached to the insulating ring and clamped to the machine. Advantageously, there is a plurality of insulating rings, stiff wires, and clamps.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
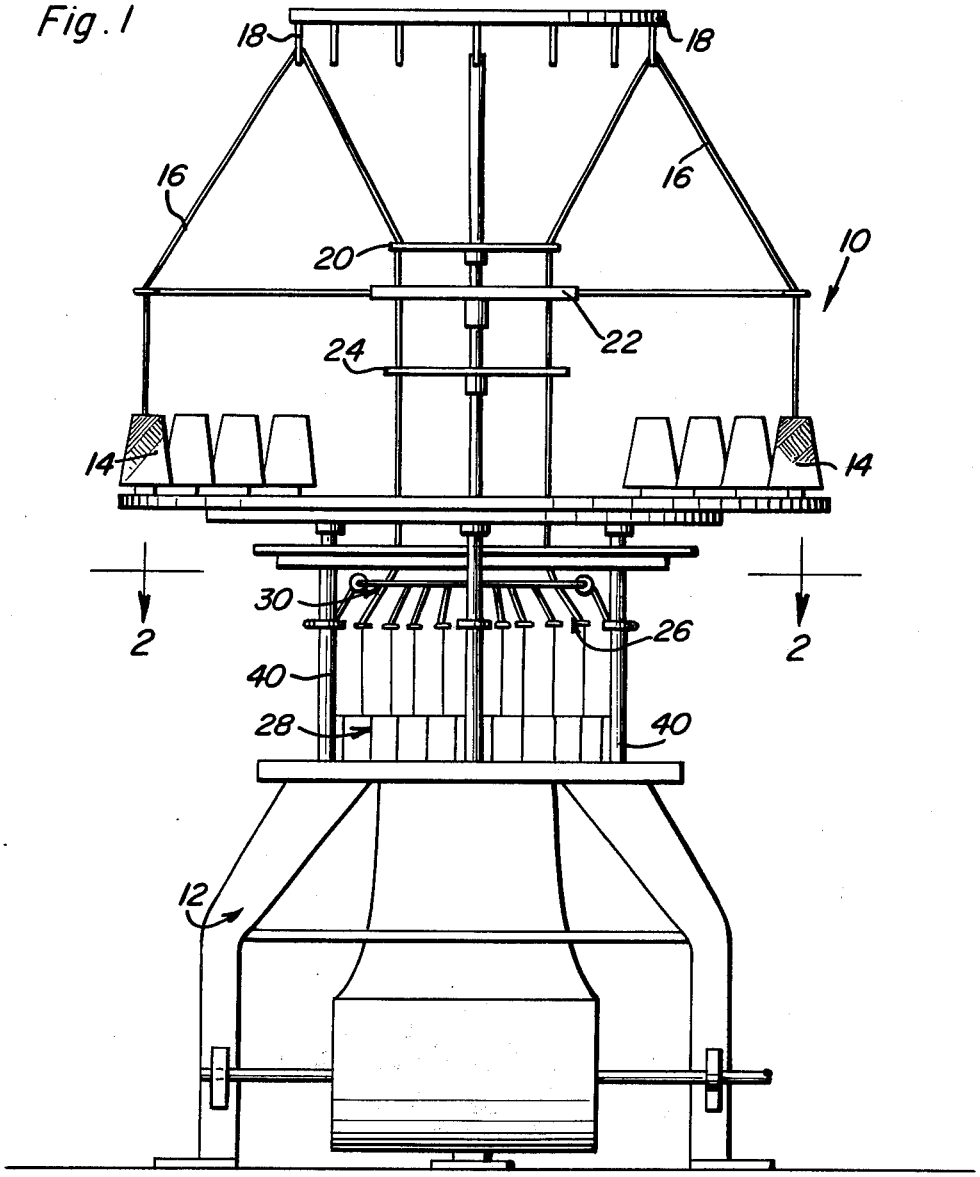
FIG. 1 is a schematic, side elevational view showing an interlock knitting machine provided with a safety ring according to the present invention.

FIG. 1 shows a circular knitting machine 10, preferably a standard interlock machine, having a frame 12. Cones 14 of yarn, and the like, are arranged on machine 10 in a conventional manner. Threads 16 pass from cones 14 and by sweeps 18, guides 20, 22, and 24, and stop motion switches 26 to a knitting area 28. Since knitting machine 10 is a standard machine as manufactured by, for example, Scott & Williams, it will not be discussed in detail herein. A safety ring 30 according to the present invention is arranged adjacent stop motion switches 26 in a manner to be discussed in detail below. The safety ring 30 cooperates with switches 26 to form a part of a stop mechanism for machine 10.

Figure 2:
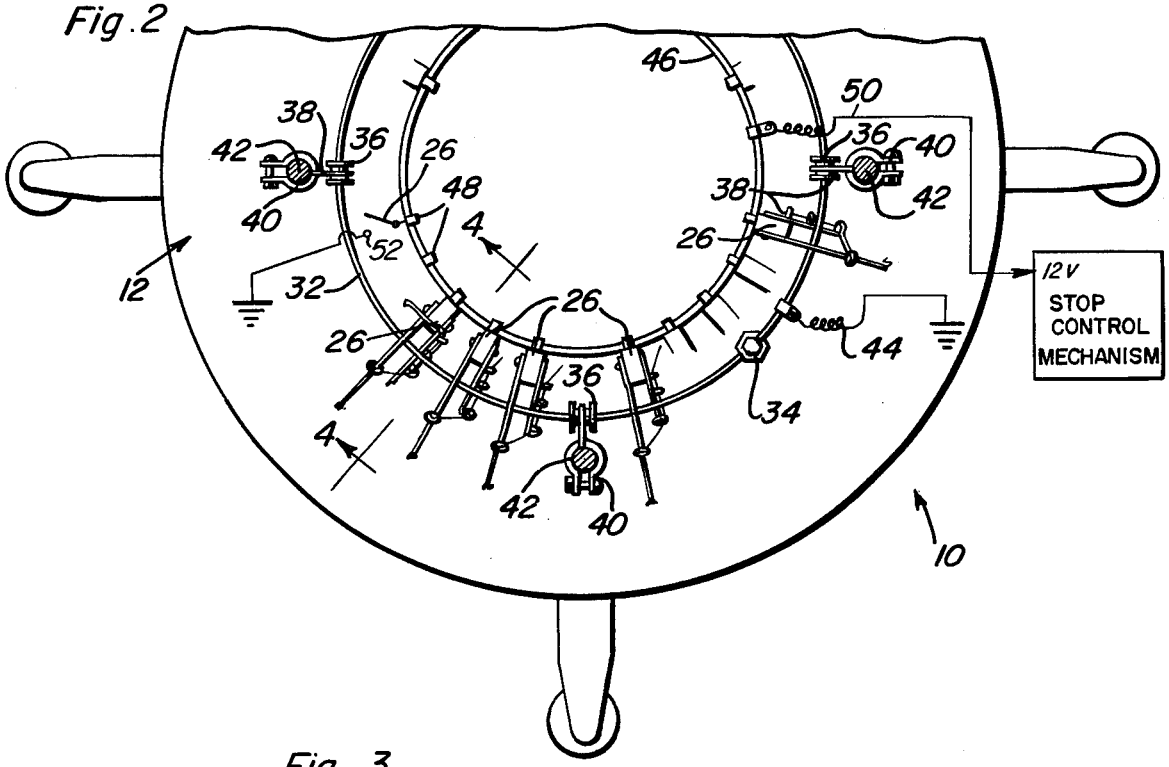
FIG. 2 is a fragmentary, sectional view taken generally along the line 2—2 of FIG. 1.
Figure 3:
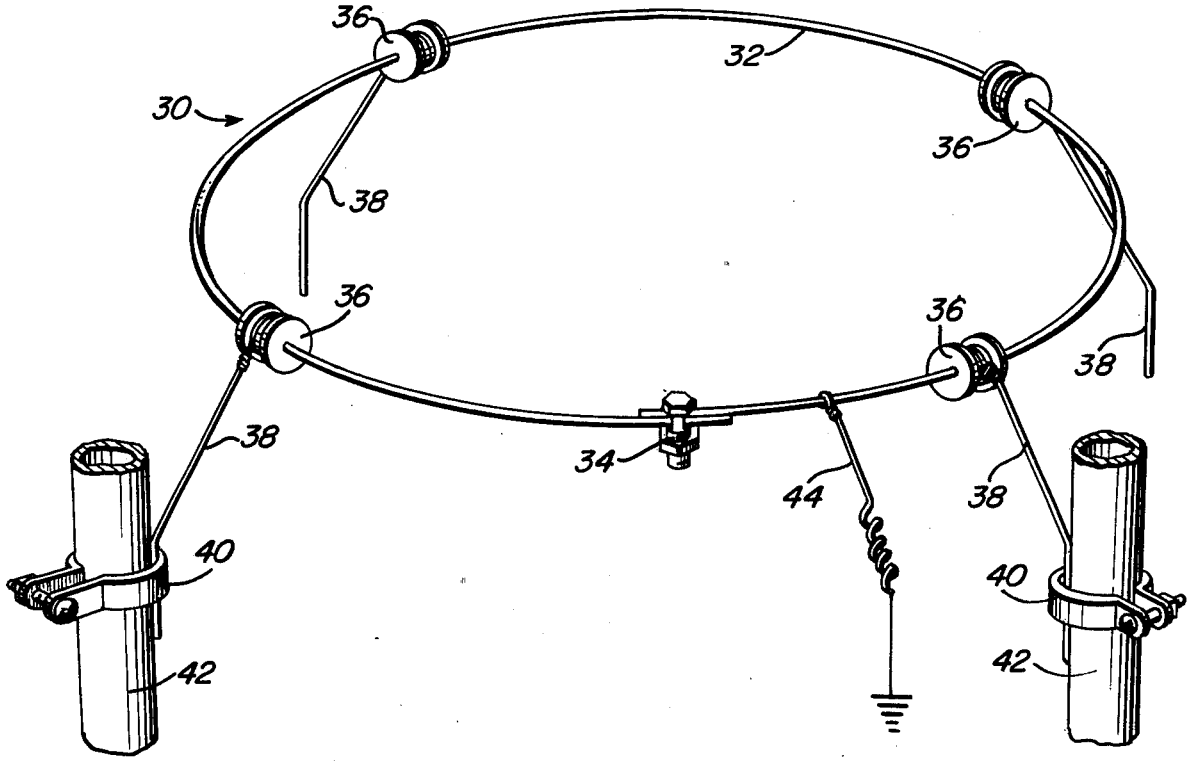
FIG. 3 is a fragmentary, perspective view showing a safety ring according to the present invention.

Referring now to FIGS. 2 and 3 of the drawings, safety ring 30 is illustrated as formed from an electrically conductive, slender bar 32, which may be constructed from, for example, copper, arranged in a circle, with the ends of bar 32 clamped together as by a conventional clamp 34. This slender bar 32 passes through a plurality, four being shown, of insulating rings 36. Insulating rings 36 are of the type conventionally constructed from an electrically insulating material such as that sold under the trademark "Bakelite". Stiff, safety ring supporting wires 38 are connected to rings 36 as by having a portion wrapped around the insulating rings, and clamps 40 clamp these wires 38 to respective upright supports 42 forming a portion of frame 12 of knitting machine 10. A conventional, electrically conducting wire 44 connects bar 32 to ground. Any conventionally employed ground may be used.

An annulus 46, constructed from an electrically conductive material, such as copper, is connected in parallel with switches 26 as by conventional clips 48 (FIGS. 2 and 4) as is conventional in standard knitting machines 10. A wire 50 is illustrated as connecting annulus 46 to a conventional source of electrical power, such as a battery; thus, annulus 46 functions as a hot lead to switches 26.

Figure 4:
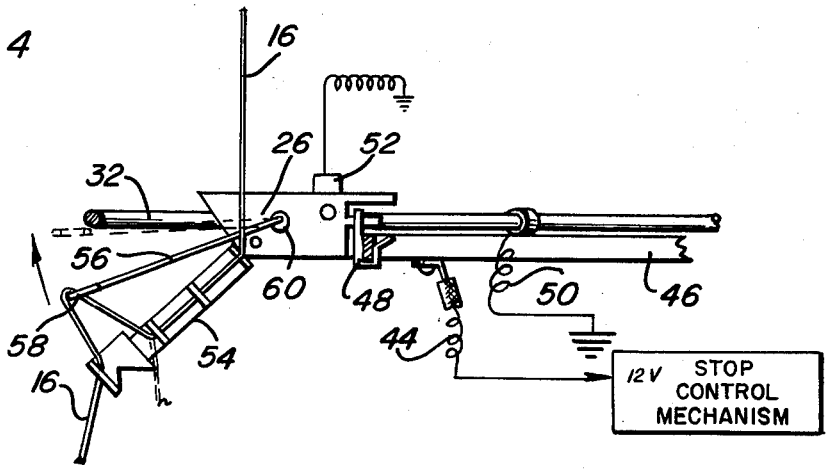
FIG. 4 is a fragmentary, sectional view taken generally along the line 4—4 of FIG. 2.

FIG. 4 of the drawings shows in detail the arrangement of a switch 26, circle-forming slender bar 32, and annulus 46. Switch 26 is mounted in a conventional manner on a support 52, which functions as a ground wire for all of the stop motion switches 26, and has an arm 54 provided with thread guides. A stop motion wire 56, which may be constructed from, for example, copper, and the like, and is provided with a loop 58 at its free end for receiving an associated thread 16, is pivotally mounted on switch 26 as at a pivot point 60. Bar 32 advantageously has a larger diameter than annulus 46, and is mounted on frame 10 so as to be approximately one inch above the full line position of stop motion wire 56 as shown in FIG. 4 of the drawings. A bar 32 having a length of, for example, seven feet has been found to be satisfactory.

As can be readily understood from the drawings and the above description, if thread 16 breaks or terminates, stop motion wire 56, which may be biased as by a torsion spring (not shown), and the like, will be released from a tension normally applied to it and will pivot in the direction of the arrow in FIG. 4 of the drawings. In the event the regular contacts of switch 26 are faulty and a circuit is not closed between annulus 46 and grounded support 52 so as to stop machine 10 in a conventional manner, as by using a controller (not shown), and the like, the pivotal movement of stop motion wire 56 will bring it in contact with bar 32 of the safety ring 30. Since stop motion wire 56 is constructed from an electrically conducting material, a circuit will be completed between the grounded safety ring 30 and annulus 46. Accordingly, safety ring 30 operates in parallel with grounded support 52 and functions as a back-up system for the stop mechanism of machine 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A stop mechanism for a knitting machine, comprising, in combination: first means for assuring stopping of the knitting machine in the event of thread breakage and failure of the normal stop motion switches; second means for forming a portion of an electrical circuit; and a stop motion switch associated with a thread of a knitting machine, and provided with contacts connected to an electrically conductive annulus, and with said first means including an electrically conducting element arranged for contacting the circuit forming means upon breakage and termination of the thread and assuring completion of an electrical circuit through the stop motion switch in the event a circuit is not closed through the contacts of said switch.

2. A structure as defined in claim 1, wherein the circuit forming means includes an electrically conductive, slender bar arranged in a circle, at least one insulating ring, the wire arranged passing through the insulating ring, means for mounting the insulating ring on a knitting machine, and means for electrically grounding the slender bar.

3. A structure as defined in claim 2, wherein the mounting means includes a wire connected to the insulating ring, and a clamp arranged for clamping the wire to a portion of a machine frame.

4. A structure as defined in claim 3, wherein there is a plurality of insulating rings, wires, and clamps.

5. A structure as defined in claim 4, wherein the electrically conducting element is a rod pivotally mounted on the associated stop motion switch, and provided with a loop at a free end for receiving an associated thread.

6. A structure as defined in claim 5, further including the annulus, the same being constructed from an electrically conductive material and connected to the contacts of the stop motion switch and to a source of electrical energy.

7. A structure as defined in claim 6, wherein there is a plurality of stop motion switches, each associated with a thread, connected in parallel to the annulus.

8. A structure as defined in claim 1, wherein the electrically conducting element is a rod pivotally mounted on the associated stop motion switch, and provided with a loop at a free end for receiving an associated thread.

9. A structure as defined in claim 8, further including the annulus, the same being constructed from an electrically conductive material and connected to the contacts of the stop motion switch and to a source of electrical energy.

10. A structure as defined in claim 9, wherein there is a plurality of stop motion switches, each associated with a thread, connected in parallel to the annulus.

* * * * *